United States Patent [19]

Langford

[11] 4,349,227

[45] Sep. 14, 1982

[54] MINING SYSTEM FOR IN SITU OIL SHALE RETORTS

[75] Inventor: William D. Langford, Clifton, Colo.

[73] Assignee: Occidental Oil Shale, Grand Junction, Colo.

[21] Appl. No.: 234,014

[22] Filed: Feb. 12, 1981

Related U.S. Application Data

[63] Continuation of Ser. No. 67,921, Aug. 20, 1979, abandoned.

[51] Int. Cl.[3] ..... E21C 41/10

[52] U.S. Cl. ..... 299/2; 102/311; 299/13

[58] Field of Search ..... 299/2, 13; 166/259, 166/299; 102/23

[56] References Cited

U.S. PATENT DOCUMENTS

| | | | |
|---|---|---|---|
| 2,481,051 | 9/1949 | Uren | 299/2 |
| 2,536,869 | 1/1951 | Bucky | 299/13 X |
| 3,001,776 | 9/1961 | Van Poollen | 299/2 |
| 3,537,753 | 11/1970 | Arendt | 299/2 |
| 4,043,595 | 8/1977 | French | 299/2 |
| 4,135,450 | 1/1979 | Lang | 299/13 |
| 4,149,595 | 4/1979 | Cha | 299/2 |
| 4,167,291 | 9/1979 | Ridley | 299/2 |

FOREIGN PATENT DOCUMENTS

| | | | |
|---|---|---|---|
| 1012564 | 6/1977 | Canada | 299/13 |

OTHER PUBLICATIONS

Lang, "The Application of Spherical Charge Technology in Stope and Pillar Mining" Engineering & Mining Journal, 5/76, pp. 98–101.

Cummins & Given SME Mining Engineering Handbook, vol. 1, 1973, pp. 12–135 to 12–150, and 12–162 to 12–233.

*Primary Examiner*—Ernest R. Purser

*Attorney, Agent, or Firm*—Christie, Parker & Hale

[57] ABSTRACT

A subterranean formation containing oil shale is prepared for in situ retorting by initially excavating a lower level drift adjacent a lower portion of an in situ oil shale retort site and excavating an air level void above the retort site. An undercut is excavated below a zone of unfragmented formation remaining within the retort site above the lower drift. The undercut tapers downwardly and inwardly to an opening in the lower drift for forming a draw point for withdrawing fragmented formation particles from the retort site. Formation within the remaining zone of unfragmented formation is explosively expanded downwardly in lifts for forming a fragmented permeable mass of formation particles containing oil shale within the retort site. A plurality of vertical blasting holes drilled in the remaining zone of unfragmented formation are loaded with explosive from the air level void prior to blasting each lift. After each lift is blasted, formation particles are withdrawn through the draw point for providing a void space with a selected void volume toward which the next lift is blasted. In one embodiment, such a selected void volume can be sufficient to provide substantially free expansion of formation within each lift. The blasting holes provide a means for access from the air level void to each new free face and to the void space below each free face for determining the void volume prior to blasting each lift. The steps of alternately blasting each lift and then withdrawing formation particles through the draw point for forming each new void space are repeated until a fragmented mass of a desired height is formed.

24 Claims, 11 Drawing Figures

MINING SYSTEM FOR IN SITU OIL SHALE RETORTS

CROSS REFERENCE TO RELATED APPLICATIONS

This is a continuation of application Ser. No. 67,921, filed Aug. 20, 1979, now abandoned.

BACKGROUND

This invention relates to in situ recovery of shale oil, and more particularly to a two-level mining system for excavation and explosive expansion of oil shale formation in preparation for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil. "

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597, and 4,043,598 which are incorporated herein by this reference. These patents describe in situ recovery of liquid and gaseous hydrocarbon materials from a subterranean formation containing oil shale, wherein such formation is explosively expanded for forming stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen-supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

It is desirable to form a fragmented mass having a reasonably uniformly distributed void fraction, i.e, a fragmented mass of reasonably uniform permeability, so that oxygen-supplying gas can flow generally uniformly through the fragmented mass during retorting operations. Techniques used for excavating void spaces in a retorting site and for explosively expanding formation toward the voids can effect the uniformity of particle size or permeability of the fragmented mass. A fragmented mass having reasonably uniform permeability in horizontal planes across the fragmented mass can avoid bypassing portions of the fragmented mass by retorting gas, which can otherwise occur if there is gas channeling through the fragmented mass owing to non-uniform permeability.

It is desirable that techniques used in excavating and explosively expanding formation within an in situ oil shale retort site provide a means for controlling the void fraction distribution within a fragmented mass being formed so that a reasonably uniformly distributed void fraction can be provided in the resulting fragmented mass.

The mining and construction costs involved in preparing a retort site for explosive expansion can be reduced by eliminating excavation of voids and corresponding retort level access drifts at intermediate levels within a retort site. Elimination of such void spaces from a retort site also can avoid the presence of large unsupported areas within a retort site where workmen can be present during mining operations. The present invention provides a two-level mining system in which a fragmented mass can be formed without excavating void spaces and corresponding retort level access drifts at different intermediate levels within a retort site. The mining system also facilitates control over void fraction distribution in the fragmented mass being formed.

SUMMARY OF THE INVENTION

According to one embodiment of this invention, a lower level drift is formed adjacent a lower portion of an in situ oil shale retort site and an upper level void is formed above the retort site, leaving a zone of unfragmented formation within the retort site. An undercut is excavated in a lower portion of the retort site above the lower level drift. A plurality of vertical blasting holes are provided in the zone of unfragmented formation within the retort site. The zone of unfragmented formation remaining within the retort site is explosively expanded downwardly toward the undercut in lifts for forming a fragmented permeable mass of formation particles containing oil shale within the retort site. Such explosive expansion in lifts is carried out by repeating the steps of loading explosive in the blasting holes from access provided by the upper level void, detonating such explosive for explosively expanding such a lift to form a portion of the fragmented mass, and withdrawing formation particles from the fragmented mass through the lower level drift prior to explosive expansion of the next lift for forming a void space of selected volume toward which the next lift is expanded. The blasting holes can provide access to the void space from the upper level void for determining the void volume of the void space prior to expansion of such a lift. The void space toward which such a lift is expanded can be sufficient to provide substantially free expansion of formation within such a lift.

The upper level void can be used as an air level drift, and the lower level drift can be a product withdrawal drift during subsequent retorting operations in the fragmented mass. This provides a two-level system in which excavation of void spaces within the retort site between the upper and lower levels can be eliminated.

DRAWINGS

These and other aspects of the invention will be more fully understood by referring to the following detailed description and the accompanying drawings in which.

DETAILED DESCRIPTION

Figure 1:
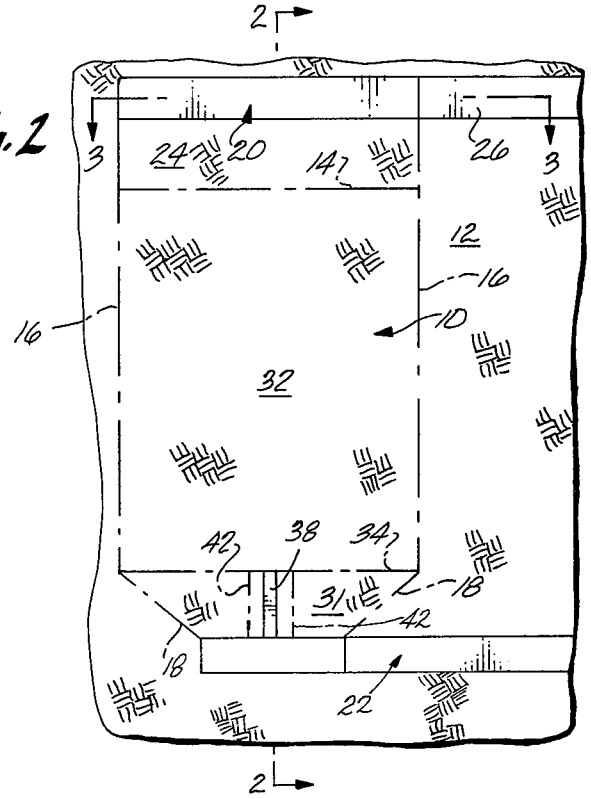
FIG. 1 is a fragmentary, semi-schematic vertical cross-section illustrating an in situ oil shale retort site at an initial stage of development according to principles of this invention.
Figure 2:
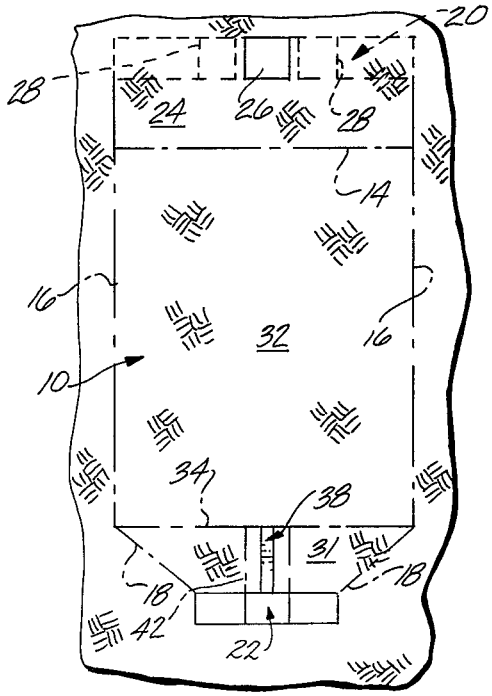
FIG. 2 is a fragmentary, semi-schematic vertical cross-section taken on line 2—2 of FIG. 1.
Figure 3:
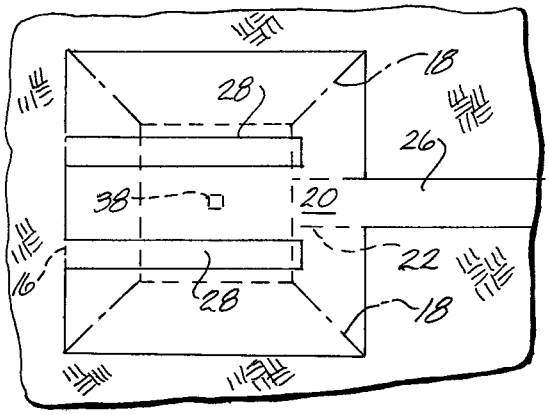
FIG. 3 is a fragmentary, semi-schematic horizontal cross-section taken on line 3—3 of FIG. 1.

FIGS. 1 through 3 schematically illustrate an initial stage of development of an in situ oil shale retort being formed in accordance with principles of this invention. The in situ retort is formed in a retort site 10 in a subterranean formation 12 containing oil shale. The in situ retort illustrated in FIGS. 1 through 3 is rectangular in horizontal cross-section, having a horizontal top boundary 14, four vertically extending side boundaries 16, and four downwardly and inwardly converging lower boundaries 18 which form a tapered lower portion of the retort being formed.

The in situ retort is formed by a two-level mining system which includes an upper level void 20 excavated horizontally across an upper level spaced above the top boundary of the retort site, and a lower level drift 22 excavated horizontally across a lower level adjacent a lower portion of the retort site.

In the illustrated embodiment, the upper level void 20 provides an open base of operation above the retort site. The floor of the base of operation is spaced above the upper boundary of the retort being formed, leaving a horizontal sill pillar 24 of unfragmented formation between the floor of the base of operation and the upper boundary of the retort being formed. The base of operation is excavated by access provided by an upper level access drift 26 excavated on the same level as the floor of the base of operation. A pair of horizontally spaced apart pillars 28 of unfragmented formation are left within the base of operation for providing temporary roof support for overburden above the base of operation. The support pillars form a generally E-shaped base of operation when the base of operation is viewed in the plan view of FIG. 3. The horizontal cross-section of the base of operation is similar to the horizontal cross-section of the retort being formed. The base of operation can provide effective access to substantially the entire horizontal cross-section of the retort being formed. The base of operation also provides access for drilling and explosive loading for subsequently explosively expanding formation within the retort site for forming a fragmented permeable mass 30 of formation particles containing oil shale (see FIG. 10) within the upper, side and lower boundaries of the retort. The base of operation also facilitates introduction of oxygen-supplying gas such as air into the top of the fragmented mass formed below the sill pillar, and for this reason the base of operation also can be referred to as an air level void.

The lower level drift 22 extends below the retort site and terminates at generally the bottom center of the retort being formed. The sloping lower boundaries 18 of the retort converge downwardly toward the end of the lower level drift, i.e., where the drift terminates at the bottom center of the retort being formed. The sloping lower boundaries 18 define a tapered lower portion 31 of the retort which is shaped generally as an inverted pyramid of rectangular cross-section. A principal upper portion 32 of the retort is formed within the four vertical side boundaries 16 of the retort. The principal upper portion of the retort is of uniform rectangular cross-sectional configuration from the upper boundry 14 down to a horizontal lower level 34 below which the retort tapers downwardly and inwardly toward the end of the lower level drift.

In an exemplary embodiment, in which the retort being formed is square in horizontal cross-section, each side of the retort, i.e., within the principal upper portion 32 of the retort, is approximately 160 feet wide, and the vertical distance from the lower level 34 to the upper boundary 14 approximately 240 feet. The heightof the entire retort from the upper boundary to the bottom of the lower level drift is approximately 320 feet.

A downwardly and inwardly tapered void 36 (see FIG. 7) is formed within the tapered lower boundaries 18 of the retort site. Since the tapered void is formed below unfragmented formation within the principal upper portion of the retort, the tapered void is referred to herein as an undercut. FIGS. 1 through 3 depict an initial stage of development of the undercut, in which a vertical raise 38 is initially excavated between the roof of the lower level drift 22 and the lower level 34 above the sloping lower boundaries of the retort. As illustrated best in FIG. 3, the raise is excavated along the vertical centerline of the retort. In one embodiment, the raise is square in horizontal cross-section, with each side of the raise being approximately eight feet wide. If desired the raise can be bored by drilling from the base of operation and drawing a raise drill upwardly along the resultant pilot hole.

The initial raise 38 is then enlarged in horizontal cross-section to form an enlarged raise 40 (see FIG. 4) approximately the same height as the initial raise. The enlarged raise is formed by explosively expanding formation toward the free faces adjacent the initial raise and the end of the lower level drift. The initial raise is preferably enlarged by ring drilling vertical blasting holes (not shown) within boundaries 42 (shown in FIGS. 1 and 2) surrounding the initial raise. In one embodiment, these blasting holes are approximately 2½ inches in diameter and are drilled in a square pattern, and the square is centered on the vertical centerline of the initial raise. Explosive is placed in these blasting holes and the explosive is detonated for explosively expanding formation within the boundaries 42 toward the initial raise and toward the end of the lower level drift. Fragmented formation particles formed as a result of blasting the enlarged raise are withdrawn from the lower portion of the raise through the lower level drift.

The void space provided by the enlarged raise provides vertical free faces toward which formation within the tapered boundaries of the lower portion 31 of the retort site is explosive expanded for forming the sloping undercut 36.

Figure 4:
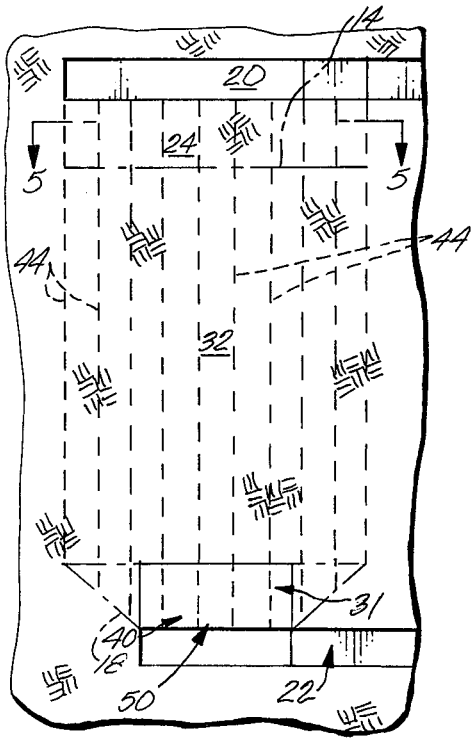
FIG. 4 is a fragmentary, semi-schematic vertical cross-section similar to FIG. 1 and showing a further stage of development in preparation for forming an undercut in a lower portion of the in situ retort site.
Figure 9:
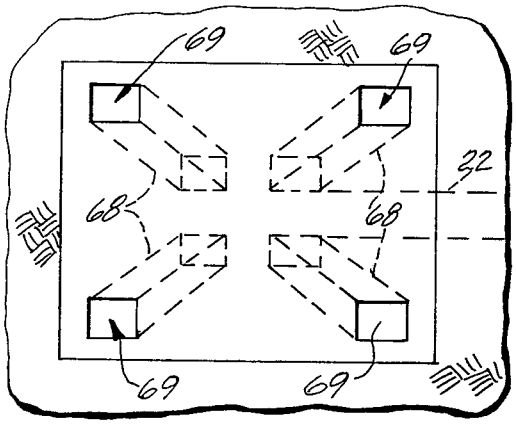
FIG. 9 is a fragmentary, semi-schematic horizontal cross-section illustrating an alternative system for withdrawing formation particles from an in situ retort.

Blasting holes are drilled within the boundaries of the retort site for explosive loading in preparation for explosively expanding formation within the retort site to form the fragmented mass 30 illustrated in FIG. 9. In the illustrated embodiment, a plurality of mutually spaced apart vertical blasting holes 44 are drilled downwardly from the base of operation 20 to the lower boundaries of the retort site. The blasting holes are preferably drilled on a square pattern illustrated best in FIG. 5, in which the blasting holes are equidistantly spaced apart in parallel rows extending across the horizontal cross-section of the retort site. As best illustrated in FIG. 4, the blasting holes drilled in the lower portion 31 of the retort site are drilled to progressively different depths to match the tapering lower boundaries of the retort being formed.

For forming the undercut 36, lower portions of the blasting holes extending through the tapering lower portion 31 of the retort site are loaded with explosive (not shown), and at least portions of the blasting holes in the principal upper portion 32 of the retort site are stemmed with an inert material such as sand or gravel. Explosive in the lower portions of the blasting holes is then detonated, preferably in a single round. This explosively expands formation within the lower portion of the retort site toward the free faces adjacent the enlarged raise 40 and toward the free face provided by the end portion of the lower level drift. This forms a first fragmented permeable mass 46 of formation particles within downwardly and inwardly tapered bottom walls 48 of the retort.

Figure 5:
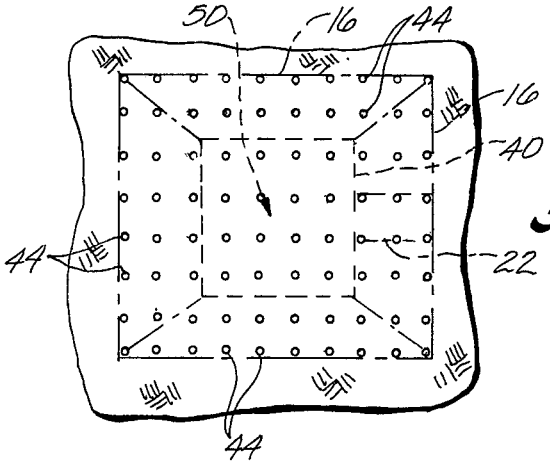
FIG. 5 is a fragmentary, semi-schematic horizontal cross-section taken on line 5—5 of FIG. 4.

An opening 50 is formed generally in a horizontal plane where the tapered bottom walls 48 of the retort converge to the roof of the lower level drift. In the illustrated embodiment, the opening, hereafter referred to as a draw point, is rectangular in horizontal cross-sectional configuration, as best illustrated in FIG. 5.

Explosive expansion for forming the undercut 36 forms a generally horizontal first free face 52 extending across the bottom of a zone of unfragmented formation remaining within the principal upper portion 32 of the retort site. In one embodiment, in which the retort being formed is square in horizontal cross-section, the first free face is approximately 160 feet wide along each side.

Figure 6:
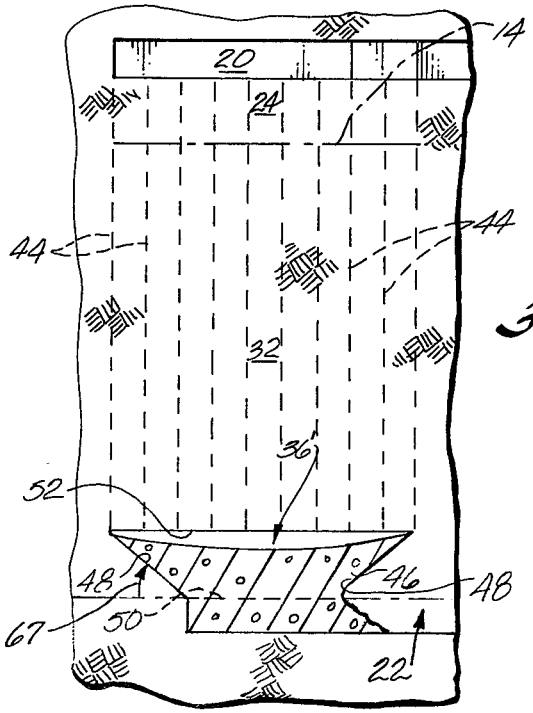
FIG. 6 is a fragmentary, semi-schematic vertical cross-section showing a stage of development in which fragmented formation particles have been explosively expanded toward the undercut.

The void space toward which formation within the lower portion of the retort site is explosively expanded for forming the undercut is of sufficient void volume that the undercut does not bulk full with formation particles following such explosive expansion. This is accomplished by explosively expanding such formation into a void volume which is greater than a limited void volume. By a limited void volume is meant that the void volume toward which such formation is expanded is smaller than the volume required for free expansion of oil shale formation. For example, when the void volume toward which such formation is explosively expanded is more than about 35% of the total volume within the boundaries of the lower zone 31 of formation being explosively expanded, plus any space in the lower level drift occupied by formation particles following explosive expansion, then such explosive expansion is toward a void volume which is greater than a limited void volume. In the illustrated embodiment, explosive expansion of formation in the lower portion of the retort site is toward a void volume greater than about 35%, and the first fragmented mass does not bulk full below the first free face 52. As shown in FIG. 6, there is a narrow void space 36' within the undercut between the top surface of the first fragmented mass 46 and the first free face.

After the first fragmented mass 46 is formed within the tapered lower portion of the retort, at least a portion of the formation particles within the first fragmented mass is withdrawn through the lower level drift to provide a desired void volume 54 (see FIG. 7) within the undercut below the first free face. As formation particles are withdrawn from the first fragmented mass through the lower level drift, formation particles pass downwardly through the draw point 50, and the upper level of the first fragmented mass is drawn downwardly to enlarge the void space above it.

After the desired void volume is provided below the first free face 52, the zone 32 of the unfragmented formation remaining within the upper portion of the retort site is explosively expanded downwardly in lifts. That is, the remaining zone is expanded downwardly by explosively expanding horizontal layers of formation within the zone in an upwardly progressing time delay sequence. Explosive expansion of each lift progressively forms a new horizontal free face in an upwardly progressing sequence. The vertical blasting holes are essentially perpendicular to each new free face, and the blasting holes provide access to each new free face from the base of operation of the upper level void. Such new free faces are represented in phantom lines at 56 in FIGS. 7 and 8.

Once the desired void volume is provided below each new free face, the bottoms of the blasting holes are grouted or plugged by suitable means, the lower portions of the blasting holes are stemmed preferably vertical column charged of explosive are loaded into the portions of the blasting holes in the central regions of the layer of formation being expanded, and the remaining upper portions of the blasting holes are stemmed. Thus an array of explosive charges is distributed across the horizontal cross-section of the layer being expanded. Explosive in the blasting holes is then detonated in a single round for explosively expanding formation within the lift downwardly toward the void space below it.

Following explosive expansion of each lift, a mass of fragmented formation particles remains within the retort site below each newly created free face. Prior to explosive expansion of each successive lift, formation particles are withdrawn through the draw point to draw down the upper level of the fragmented mass remaining within the retort site below the previously formed free face. A sufficient amount of formation particles is removed after each blast to provide a desired void volume within the void space toward which the next lift is explosively expanded. The vertical blasting holes provide access to each void space from the void space within the the upper level void for determining void volume prior to each explosive expansion step, as and described below.

Figure 7:
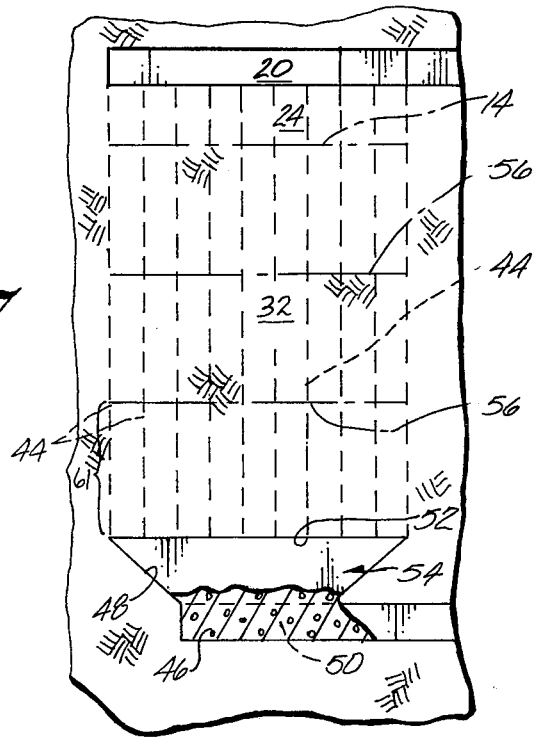
FIG. 7 is a fragmentary, semi-schematic vertical cross-section showing a stage of development in which fragmented formation particles have been removed from the undercut.
Figure 8:
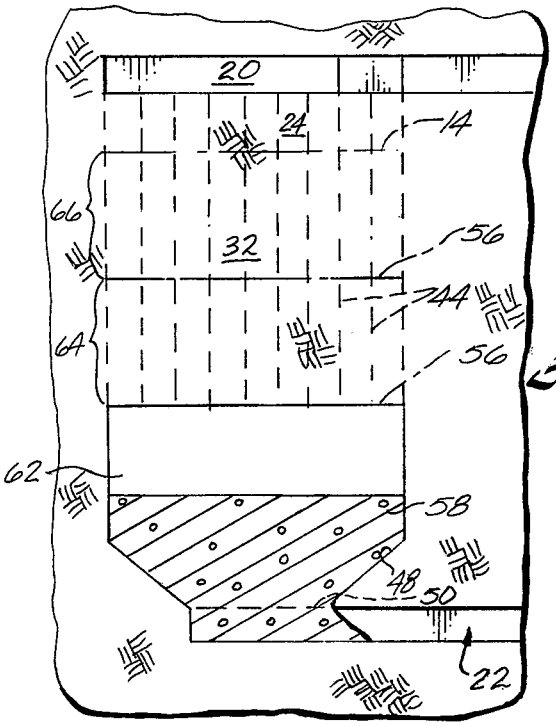
FIG. 8 is a fragmentary, semi-schematic vertical cross-section showing a stage of development in which formation above the undercut is explosively expanded downwardly in lifts.

FIG. 7 shows a first layer 61 of unfragmented formation to be explosively expanded downwardly in the first lift. FIG. 8 shows the retort after the first lift has been expanded, forming a larger fragmented mass 58 of formation particles within the lower portion of the retort site below a second horizontal free face 60 at a level above the first free face. A sufficient amount of formation particles can be withdrawn from the fragmented mass 58 through the draw point 50 to provide a void space 62 of a desired void volume below the second free face. A second layer 64 of formation above the second free face is then explosively expanded downwardly toward the second free face for further enlarging the fragmented mass of particles in the retort. The steps of alternately blasting downwardly in lifts and withdrawing formation particles through the draw point to provide a desired void volume for each successive lift are repeated until an upper layer 66 of formation is explosively expanded for forming an upper portion of the fragmented mass below the upper boundary 14 of the retort site.

Preferably, sufficient formation particles are withdrawn from the draw point prior to expansion of each lift to provide a void space below each lift with a large enough void volume to allow essentially free expansion of oil shale toward the void space during explosive expansion of the lift. Such free expansion promotes high and reasonably uniform permeability of the resulting fragmented mass. It is desirable to provide a void volume that results in the fragmented mass being close to the newly created free face following explosive explosion of each lift. Such explosive expansion can leave a narrow void space between each newly created free face and the top surface of the newly created fragmented mass. This provides a means for controlling void fraction distribution in the fragmented mass throughout formation of the fragmented mass. In one embodiment, the void volume is such that the fragmented mass occupies at least a portion of the volume originally occupied by the formation within the lift previously expanded. A void volume of from about 25% to about 30% below each lift is sufficient to provide the desired expansion and desired level of the resulting fragmented mass. Prior to explosively expanding the upper layer 66, care is taken to withdraw only a sufficient amount of formation particles from the draw point to ensure that the void left above the fragmented mass, following expansion of the upper layer, is either minimal or the retort is bulked full to provide support for the overlying sill pillar. In this instance, a void space below the upper layer having a void volume of about 23% to 25%, based on the total volume of the void space plus the upper layer, provides the desired bulking full.

The volume of the void space below each newly created free face is measured after each blast so that a desired void volume can be provided below each newly created free face prior to expansion of the next lift. The void volume is measured by using the vertical blasting holes 44 as a means for access from the upper base of operation for determining the elevation of each newly created free face and the elevation of the fragmented mass below the free face. As formation particles are withdrawn through the draw point, the elevation of the top surface of the fragmented mass can be measured by access provided from the base of operation through the blasting holes so that a sufficient amount of particles can be withdrawn to provide the desired void volume below each free face. Probes (not shown) or similar means can be inserted through the blasting holes to detect the elevation of the fragmented mass and the new free face below each blasting hole. Since the blasting holes are distributed generally uniformly across the horizontal cross-section of the fragmented mass, the elevation of each new free face and the elevation of the fragmented mass can be measured at a large number of points so that the resulting void volume can be accurately measured and controlled.

Thus, formation within the main portion 32 of the retort site is explosively expanded in lifts by repeating the steps of measuring through the blasting holes to determine the existing void volume, withdrawing particles from the draw point to provide the desired void volume, sealing the bottoms of the blasting holes, loading explosive in the blasting holes and stemming remaining portions of the blasting holes, detonating the explosive for forming a new fragmented mass of particles below a new free face, and withdrawing formation particles from the draw point for enlarging the void space below the newly created free face in preparation for expanding the next lift.

Figure 11:
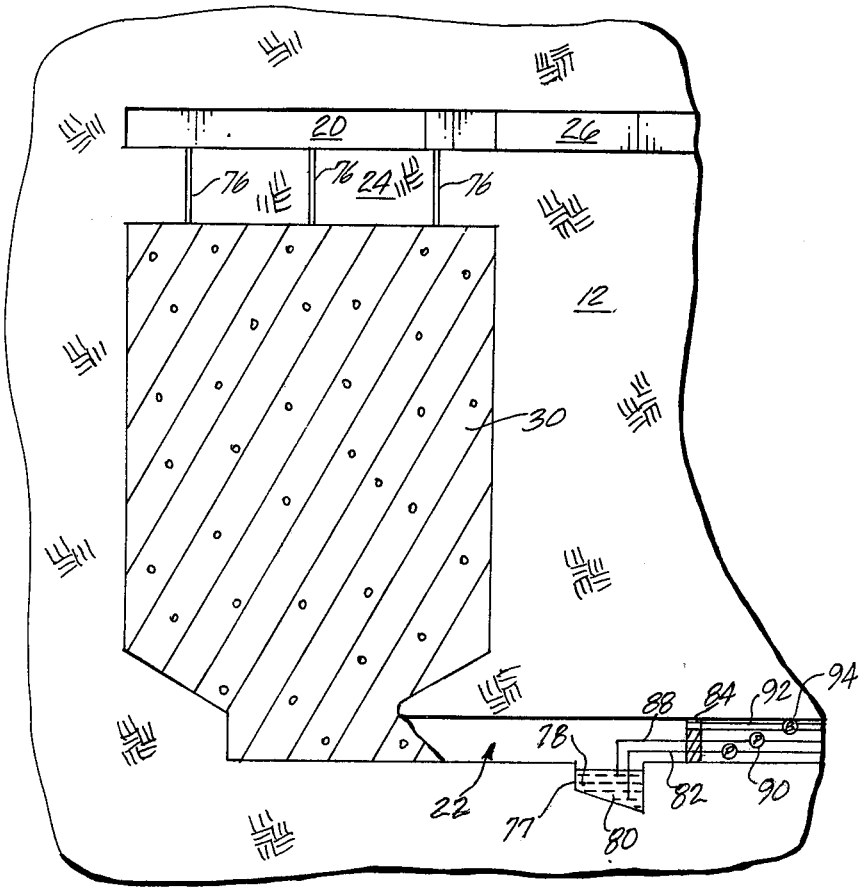
FIG. 11 is a fragmentary, semi-schematic vertical cross-section showing a completed in situ oil shale retort prepared according to principles of this invention.

In an alternative embodiment, the layer of formation within the sill pillar can be explosively expanded as a final step in forming the fragmented mass. The sill pillar can be blasted down as well as up toward the upper level void, and the uper level void provides the void space for a portion of the resulting fragmented mass. In this embodiment, oxygen-supplying gas can be introduced to the top of the fragmented mass from the side of the retort during retorting operations, instead of from above as illustrated in FIG. 11.

In another alternative embodiment, layers of formation, or lifts, within the retort site can be explosively expanded toward a limited void provided by the void space below each lift prior to expansion.

The undercut 36 can be formed so that the tapered bottom walls 48 of the retort are on an angle similar to the approximate natural angle of repose of fragmented formation particles containing oil shale. In the illustrated embodiment, each tapered bottom wall extends on an angle of approximately 38° to 42° relative to a horizontal plane through the wall, as represented by the angle at 67 in FIG. 6. A steeper angle can be used if desired to maintain a reasonably flat upper surface on the mass of particles in the retort. By forming the tapered bottom walls near the natural angle of repose of fragmented oil shale, and using a relatively wide draw point at the bottom, the top surface of the fragmented mass can remain reasonably level as formation particles are being withdrawn through the draw point. In some instances, several horizontally spaced apart draw point openings can be formed at the lower level to assist in maintaining a reasonably level top surface of the fragmented mass. An example of an alternative system using several mutually spaced apart draw point openings is illustrated in FIG. 9 wherein several upwardly extending tunnels 68 are excavated between the lower level drift and corresponding draw point openings 69 in the lower portion of the retort.

The two-level mining system described herein can reduce mining costs when compared with a mining system in which multiple intermediate level voids are driven through a retort site, and formation is expanded toward such multiple voids, or in which such multiple voids are used for access for explosive loading or removal of fragmented formation particles. Any safety hazards involved in personnel working under large unsupported areas within a retort site also are avoided by the two-level mining system herein in which explosive loading and measuring to determine void volume prior to expansion of each lift are carried out by personnel working in the upper base of operation. Drawing of particles from the bottom is through draw points to the lower level drift and personnel work safely with the lower level drift.

Figure 10:
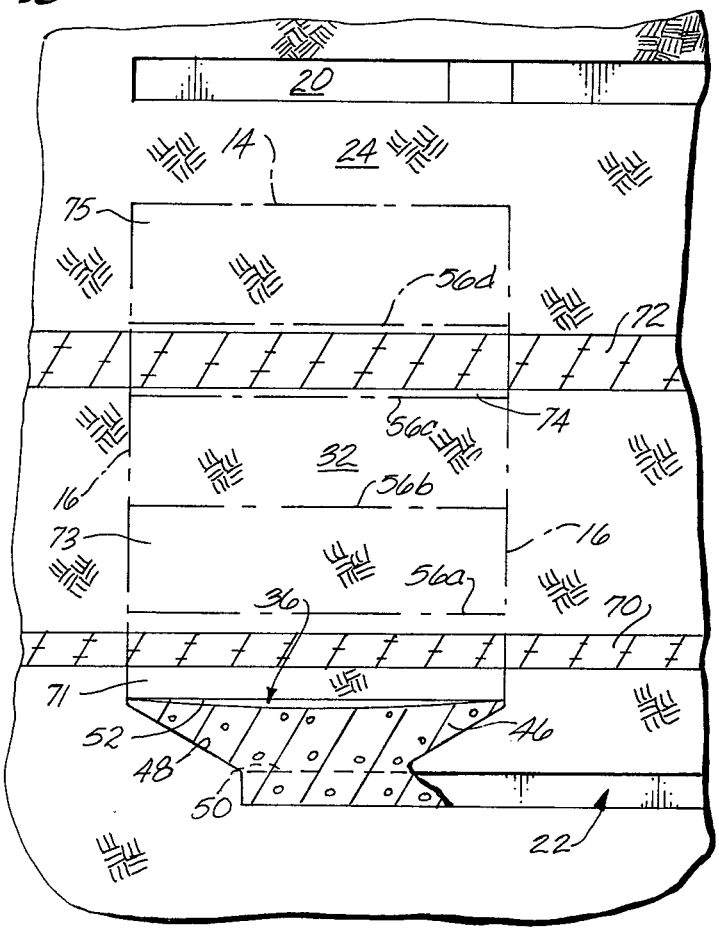
FIG. 10 is a fragmentary, semi-schematic vertical cross-section showing an alternative method of forming an in situ oil shale retort according to principles of this invention.

In one embodiment, the method described herein can permit void volume to be controlled and varied at different levels within the retort site to correspond with the grade of oil shale present at different levels within the retort site. For example, FIG. 10 illustrates a technique in which the method described herein provides a differing void fraction at different levels within a fragmented mass to correspond to variations in kerogen content at different levels within the retort site. It is desirable to form a fragmented mass in which fragmented formation particles from a stratum of higher kerogen content have a larger void fraction than fragmented formation particles from a region of lower kerogen content. Such a variation in void fraction can avoid a substantial increase in resistance to gas flow through the fragmented mass due to the relatively higher thermal expansion of fragmented formation particles having the higher kerogen content. A more complete description of this phenomenon and techniques for forming a fragmented mass in a retort site with variations in kerogen content are in U.S. Pat. application Ser. No. 865,704, filed Dec. 29, 1977, entitled "Method for Forming An In Situ Oil Shale Retort With Void Volume as Function Of Kerogen Content Of Formation Within Retort Site", now U.S. Pat. No. 4,167,291 and U.S. Pat. No. 4,149,595, assigned to the assignee of this application and incorporated herein by this reference.

The example of FIG. 10 illustrates a first stratum 70 and a second stratum 72 of formation each having a higher kerogen content than the average kerogen content of formation within the retort site. Each stratum extends generally horizontally across the retort site, and the second stratum is spaced above the first stratum and is of greater thickness than the first stratum. Formation within the retort site shown in FIG. 10 is explosively expanded downwardly in lifts, according to the techniques described above, and formation particles are withdrawn from the draw point 50 for providing the desired void volume below each newly created free face prior to expansion of each successive lift. The vertical blasting holes drilled from the upper base of operation through the retort site are not illustrated in FIG. 10 for simplicity. In the example illustrated in FIG. 10, the first stratum 70 of higher kerogen content extends through a first layer 71 of formation to be expanded in a first lift for forming a new free face **56*a* below a second layer 73 of formation. The second stratum 72 of higher kerogen content extends through a fourth layer 74 of formation to be expanded in a fourth lift for forming a new free face 56*d* below a first layer 75** of formation.

Formation with the retort site can be explosively expanded in lifts each having a thickness proportional to the kerogen content within the lift being expanded. In the illustrated embodiment, the first layer of formation has a greater depth or thickness than the thickness of the fourth layer of formation, since the first stratum of higher kerogen content is not as thick as the second stratum of higher kerogen content. The first and fourth layers each have a thickness which is less than the thickness of the other layers of formation to be expanded in lifts. These other layers of formation have a lower average kerogen content than the average kerogen content of the first and second strata. Thus, the thickness of each layer to be expanded is generally inversely proportional to the average kerogen content of formation with the lift, where kerogen content is a measure of kerogen per volume of formation within the layer.

In one embodiment, prior to explosively expanding each layer, formation particles can be withdrawn through the draw point to provide substantially the same void volume below each lift to be expanded. Since all void volumes are substantially the same, and since the fourth layer has the highest average kerogen content of the layers to be expanded, and since it has a lower thickness than the other lifts, the portion of the fragmented mass produced by expansion of the fourth layer has the highest void fraction. The first layer has a lower average kerogen content than the fourth layer, but the first layer has a higher kerogen content than the remaining layers, so the portion of the fragmented mass produced by expansion of the first layer has a void fraction less than that produced by expansion of the fourth layer but greater than that mass produced by expansion of the other layers.

As an alternative to the techniques illustrated in FIG. 10, void fraction variation with kerogen content can be provided by explosively expanding layers of the same thickness, but by withdrawing different amounts of formation particles from below each new free face to correspond to the kerogen content in the layer or lift above the free face. That is, the volume of the void space provided below each layer to be expanded can be directly proportional to the kerogen content of the layer. In this manner, a layer having a higher than average kerogen content is expanded to provide a region in the fragmented mass with a higher than average void fraction, and vice versa.

Following explosive expansion for forming the fragmented mass 30 illustrated in FIG. 11, retorting operations are conducted within the fragmented mass by initially igniting formation particles at the top of the fragmented mass to establish a combustion zone at the top of the fragmented mass. Air or other oxygen-supplying gas supplied to the combustion zone from the air level drift or base of operation through vertical air passages 76 sustains the combustion zone and advances it downwardly through the fragmented mass. Combustion gas produced in the combustion zone passes through the fragmented mass to establish a retorting zone on the advancing side of the combustion zone wherein kerogen in the fragmented mass is converted to liquid and gaseous products. As the retorting zone moves down through the fragmented mass, liquid and gaseous products are released from the fragmented formation particles. A sump 77 in the portion of the production level drift 22 beyond the fragmented mass collects liquid products, namely, shale oil 78 and water 80, produced during operation of the retort. A water withdrawal line 82 extends from near the bottom of the sump out through a sealed opening in a bulkhead 84 sealed across the production level drift. The water withdrawal line is connected to a water pump 86. An oil withdrawal line 88 extends from an intermediate level of the sump out through a sealed opening in the bulkhead and is connected to an oil pump 90. The water and oil pumps can be operated manually or by automatic controls (not shown) to remove shale oil and water separately from the sump. Off gas is withdrawn from behind the bulkhead by an off gas line 92 sealed through the bulkhead and connected to a blower 94.

Thus, a two-level mining system is provided which permits control of the void fraction of the fragmented mass as a fragmented mass is being formed in an upwardly progressing sequence. The two-level mining system is defined herein as a mining system with separate drifts or void spaces formed above and below formation within the retort site, independently of the need for other voids and corresponding retort level access drifts at intermediate levels of the retort site. In the present invention, the upper level drift or void space serves as an upper base of operation for controlling formation of the fragmented mass, while also serving as an air level void during production. The lower level drift serves as a means for access to a lower region of the retort site for forming the fragmented mass, it serves as a means for withdrawing formation particles during formation of the fragmented mass, and it provides a product level drift during production. Thus, the two-level system can provide means for controlling the void fraction distribution within the fragmented mass so that a reasonably uniformly distributed void fraction can be provided, while also reducing mining and construction costs involved in forming the fragmented mass when compared with systems having one or more intermediate level void and drift systems. The two-level mining system also can eliminate presence of personnel beneath large unsupported areas within the retort site during mining operations.

What is claimed is:

1. A method for recovering liquid and gaseous products from an in situ oil shale retort formed in a retort site in a subterranean formation containing oil shale, such an in situ oil shale retort containing a fragmented permeable mass of formation particles containing oil shale, the method comprising the steps of:

excavating an upper level void in such formation adjacent an upper portion of the retort site, the upper level void providing access to substantially the entire horizontal cross section of the fragmented mass being formed;

excavating a lower level drift in such formation adjacent a lower portion of the retort site;

excavating an undercut in a lower portion of the retort site including at least a portion at elevations above the lower level drift, the undercut opening into the lower level drift and being larger in vertical cross section than the lower level drift, and leaving a zone of unfragmented formation within the retort site above the undercut;

providing one or more vertical blasting holes in the zone of unfragmented formation;

explosively expanding the zone of unfragmented formation in lifts for forming a fragmented permeable mass of formation particles containing oil shale within the retort site, such explosive expansion being carried out by repeating the steps of:

placing explosive in the vertical blasting holes from access provided by the upper level void;

detonating such explosive for explosively expanding such a lift to form at least a portion of the fragmented mass below a portion of the zone of unfragmented formation remaining within the retort site; and withdrawing formation particles from the fragmented mass through the lower level drift to provide a void space of selected void volume below such a remaining zone of unfragmented formation prior to explosively expanding the next lift, the void volume of said void space being determined by access provided from the upper level void by such a vertical blasting hole extending through such a remaining portion of the zone of unfragmented formation;

establishing a retorting zone within the fragmented mass and advancing the retorting zone downwardly through the fragmented mass for producing liquid and gaseous products of retorting; and withdrawing the liquid and gaseous products of retorting from a lower portion of the fragmented mass.

2. The method according to claim 1 in which formation particles are withdrawn following at least a portion of such explosive expansion steps by withdrawing a volume of formation particles that provides a sufficient void volume in such a void space for free expansion of formation during explosive expansion of the next lift.

3. The method according to claim 1 in which the void volume of such a void space is from about 25% to about 30% of the total volume occupied by the void space and the lift being expanded toward the void space.

4. A method for forming an in situ oil shale retort within a retort site in a subterranean formation containing oil shale, such an in situ oil shale retort containing a fragmented permeable mass of formation particles containing oil shale, the method comprising the steps of:

excavating a lower level drift in such formation adjacent a lower portion of the retort site, and excavating an upper level base of operation in such formation adjacent an upper portion of the retort site, the base of operation providing access to substantially the entire horizontal cross section of the retort site;

forming an initial void space within a lower portion of the retort site including at least a portion at elevations above the lower level drift, the initial void space communicating with the lower level drift and being enlarged in cross section relative to the cross section of the lower level drift, leaving a remaining zone of unfragmented formation with the retort site, above the initial void space;

providing a plurality of mutually spaced apart substantially vertical blasting holes extending from the upper base of operation into such remaining zone of unfragmented formation; and explosively expanding portions of such remaining zone of unfragmented formation downwardly in lifts in an upwardly progressing sequence by alternately detonating explosive charges placed in the blasting holes in each such successive lift and withdrawing formation particles through the lower level drift prior to explosively expanding the next successive lift for forming a void space of selected void volume below a newly created free face adjacent each lift to be expanded for forming a fragmented permeable mass of formation particles containing oil shale below such void space, the void volume of such a void space below a newly created free face being determined from locations within the base of operation by access provided to such void space through the blasting holes.

5. The method according to claim 4 including withdrawing a sufficient amount of formation particles through the lower level drift for providing a void space that permits substantially free expansion of formation in such a lift explosively expanded toward such a void space.

6. The method according to claim 4 in which such a lift is explosively expanded by detonating an array of vertical column charges of explosive placed across the horizontal cross-section of such lift.

7. The method according to claim 4 including withdrawing formation particles by drawing them downwardly from the retort over a sufficiently wide area to maintain a generally level top surface of the fragmented mass.

8. The method according to claim 4 in which the void volume of such a void space toward which such a lift is expanded is from about 25% to about 30% of the total volume occupied by such void space and the lift being explosively expanded toward such void space.

9. A method for forming an in situ oil shale retort within a retort site in a subterranean formation containing oil shale, such an in situ retort containing a fragmented permeable mass of formation particles containing oil shale, the method comprising the steps of:

excavating a lower level drift in such formation adjacent a lower portion of the retort site, and excavating an upper level void in such formation adjacent an upper portion of the retort site, the upper level void providing access to substantially the entire horizontal cross section of the retort site;

forming an initial void space within a lower portion of the retort site, the initial void space communicating with the lower level drift and being enlarged relative to the cross section of the lower level drift, and leaving a remaining zone of unfragmented formation within the retort site above the initial void and having an initial substantially horizontal free face above the initial void;

providing a plurality of vertical blasting holes extending from the upper level void into such a remaining zone of unfragmented formation, such vertical blasting holes being distributed across the horizontal cross section of the retort site; and explosively expanding such a remaining zone of unfragmented formation downwardly toward the initial void space in lifts in an upwardly progressing sequence for forming a fragmented permeable mass of formation particles containing oil shale within the retort site by repeating the steps of:

(1) detonating explosive placed in the blasting holes for explosively expanding such a lift;

(2) withdrawing formation particles from the fragmented mass through the lower level drift following explosive expansion of such a lift; and (3) determining the location of a new free face formed after explosive expansion of such a lift and determining the level of the fragmented mass below such a new free face, via access provided to such a free face and the fragmented mass by the vertical blasting holes, for withdrawing sufficient formation particles from the fragmented mass to provide a void space of a selected void volume below such a new free space prior to explosively expanding the next lift.

10. The method according to claim 9 including withdrawing a sufficient amount of formation particles for providing substantially free expansion of formation in such a lift toward such a void space.

11. The method according to claim 9 in which such a lift is explosively expanded by detonating, in a single round, an array of vertical column charges of explosive placed across the horizontal cross-section of such lift.

12. The method according to claim 9 including withdrawing formation particles from the retort by drawing them downwardly through one or more draw points having a sufficiently large cross-section for maintaining a substantially level top surface of the fragmented mass.

13. The method according to claim 9 in which the void volume toward which such a lift is freely expanded is from about 25% to about 30% of the total volume of such void space and such a lift being expanded toward such void space.

14. A method for forming a two-level in situ oil shale retort within a retort site in a subterranean formation containing oil shale, such an in situ retort containing a fragmented permeable mass of formation particles containing oil shale, the method comprising the steps of:

excavating a production level drift in such formation adjacent a lower portion of the retort site;

forming an initial void space within a lower portion of the retort site including at least a portion at elevations above the production level void, the initial void space communicating with the production level drift and being larger in cross section than the production level drift, and leaving a remaining zone of unfragmented formation within the retort site above the initial void;

providing a plurality of vertical blasting holes into such remaining zone of unfragmented formation;

explosively expanding such remaining zone of unfragmented formation downwardly toward the initial void space in lifts in an upwardly progressing sequence for forming a fragmented permeable mass of formation particles containing oil shale within the retort site by repeating the steps of:

(1) detonating explosive placed in such blasting holes for explosively expanding such a lift to form a separate portion of such a fragmented mass;

(2) withdrawing formation particles through the production level drift prior to explosively expanding each successive lift for forming a void space of selected void volume below a remaining portion of the zone of unfragmented formation to be explosively expanded in the next lift; and (3) determining the void volume of such a void space by access provided to such void space through the vertical blasting holes;

establishing a combustion zone within the fragmented mass and advancing the combustion zone downwardly through the fragmented mass by introducing oxygen-supplying gas to the fragmented mass for establishing a retorting zone on the advancing side of the combustion zone for producing liquid and gaseous products of retorting within the fragmented mass; and withdrawing the liquid and gaseous products of retorting from the production level drift.

15. The method according to claim 14 in which the fragmented mass is formed within generally upright side boundaries of the retort site; and in which the fragmented mass is formed in the absence of any retort level access drifts being excavated through the side boundaries of the retort site at elevations above the production level drift.

16. A method for forming an in situ oil shale retort within a subterranean formation containing oil shale, such an in situ oil shale retort containing a fragmented permeable mass of formation particles containing oil shale, wherein formation within the retort site contains at least one formation stratum having a higher kerogen content than the average kerogen content of formation within the retort site, the method comprising the steps of:

excavating a lower level drift in such formation adjacent a lower portion of the retort site;

forming an initial void space within a lower portion of the retort site leaving a remaining zone of unfragmented formation within the retort site, the initial void space communicating with the lower level drift; and explosively expanding such remaining zone of unfragmented formation downwardly in lifts in an upwardly progressing sequence by repeating the alternating steps of detonating explosive charges placed in such a lift of unfragmented formation to be explosively expanded and withdrawing formation particles through the lower level drift prior to explosively expanding the next successive lift for forming a void space of selected void volume below the next successive lift to be expanded and a fragmented permeable mass of formation particles containing oil shale, below such void space of selected void volume such void space being provided with a void volume generally directly proportional to the kerogen content of the next successive lift to be explosively expanded toward such a void space for providing a fragmented mass with a higher void fraction in a region thereof containing particles from such a stratum of higher kerogen content than the average void fraction of the entire fragmented mass.

17. A method for forming an in situ oil shale retort within a subterranean formation containing oil shale, such an in situ oil shale retort containing a fragmented permeable mass of formation particles containing oil shale, wherein formation within the retort site contains at least one formation stratum having a higher kerogen content than the average kerogen content of formation within the retort site, the method comprising the steps of:

excavating a lower level drift in such formation adjacent a lower portion of the retort site;

forming an initial void space within a lower portion of the retort site leaving a zone of unfragmented formation remaining within the retort site, the initial void space communicating with the lower level drift; and explosively expanding such remaining zone of unfragmented formation downwardly in lifts by detonating in an upwardly progressing sequence explosive charges placed in such a lift in the remaining zone of formation to be explosively expanded and withdrawing formation particles through the lower level drift prior to explosively expanding each successive lift for forming a void space of selected void volume below the next successive lift to be expanded for forming a fragmented permeable mass of formation particles containing oil shale, below such void space of selected void volume, the thickness of each lift to be expanded downwardly toward a corresponding void space being generally inversely proportional to the kerogen content within the lift being expanded for providing a fragmented mass with a higher void fraction in a region thereof containing particles from such a stratum of higher kerogen content than the average void fraction of the entire fragmented mass.

18. A method for recovering liquid and gaseous products from an in situ oil shale retort formed in a retort site in a subterranean formation containing oil shale, such as in situ oil shale retort containing a fragmented permeable mass of formation particles containing oil shale, the method comprising the steps of:

excavating a lower level drift in such formation adjacent a lower portion of the retort site;

excavating an undercut in a lower portion of the retort site including at least a portion at elevations above the lower level drift, the undercut opening into the lower level drift, and leaving a zone of unfragmented formation within the retort site above the undercut;

providing one or more blasting holes in the remaining zone of unfragmented formation;

explosively expanding the zone of unfragmented formation in lifts in an upwardly progressing sequence for forming a fragmented permeable mass of formation particles containing oil shale within the retort site, such explosive expansion being carried out by repeating the steps of:

placing explosive in the blasting holes in the lift to be expanded;

detonating such explosive for explosively expanding such a lift to form at least a portion of the fragmented permeable mass of formation particles below a portion of the zone of unfragmented formation remaining within the retort site; and withdrawing a portion of the formation particles from the fragmented mass through the lower level drift to provide a void space between the top of the portion of the fragmented mass and such a remaining portion of the zone of unfragmented formation prior to explosively expanding the next lift, the void volume of said void space being sufficient for free expansion of formation during explosive expansion of the next lift;

establishing a retorting zone within the fragmented mass and advancing the retorting zone downwardly through the fragmented mass for producing liquid and gaseous products of retorting; and withdrawing the liquid and gaseous products of retorting from a lower portion of the fragmented mass.

19. A method according to claim 18 wherein the horizontal cross section of the undercut is similar to the horizontal cross section of the retort site.

20. A method for forming an in situ oil shale retort within a retort site in a subterranean formation containing oil shale, such an in situ oil shale retort containing a fragmented permeable mass of formation particles containing oil shale, the method comprising the steps of:

excavating a lower level drift in such formation adjacent a lower portion of the retort site;

forming an initial void space within a lower portion of the retort site including at least a portion at elevations above the lower level drift, the initial void space communicating with the lower level drift and being enlarged in horizontal cross section relative to the horizontal cross section of the lower level drift, leaving a remaining zone of unfragmented formation within the retort site, above the initial void space having a horizontally extending free face above the initial void space;

providing a plurality of mutually spaced apart substantially vertical blasting holes extending into such a remaining zone of unfragmented formation; and explosively expanding portions of such a remaining zone of unfragmented formation downwardly in lifts in an upwardly progressing sequence within the retort site for forming portions of the fragmented permeable mass of formation particles containing oil shale by alternately detonating an array of vertical columnar explosive charges placed in the blasting holes and withdrawing a portion of the formation particles through the lower level drift prior to explosively expanding the next successive lift for forming a void space between the top of the fragmented mass and a newly created horizontally extending free face adjacent the next successive lift to be explosively expanded, such a void space having sufficient void volume to permit substantially free expansion of formation in such next successive lift when it is explosively expanded toward such void space.

21. The method according to claim 20 including withdrawing formation particles by drawing them downwardly from the retort over a sufficiently wide area to maintain a generally level top surface of the fragmented mass.

22. A method for forming an in situ oil shale retort within a retort site in a subterranean formation containing oil shale, such an in situ retort containing a fragmented permeable mass of formation particles containing oil shale, the method comprising the steps of:

excavating a lower level drift in such formation adjacent a lower portion of the retort site;

forming an initial void space within a lower portion of the retort site, the initial void space communicating with the lower level drift and being enlarged to substantially the entire horizontal cross section of the retort site, and leaving a remaining zone of unfragmented formation within the retort site above the initial void space and having an initial free face adjacent the initial void space;

providing a plurality of blasting holes within the remaining zone of unfragmented formation, such blasting holes being distributed across the horizontal cross section of the retort site; and explosively expanding the remaining zone of unfragmented formation downwardly toward the initial void space in lifts in an upwardly progressing sequence for forming a fragmented permeable mass of formation particles containing oil shale within the retort site by repeating the steps of:

(1) detonating explosive placed in the blasting holes in a lift to be explosively expanded for explosively expanding such lift and forming a portion of the fragmented mass of formation particles in the initial void space;

(2) determining the location of a new free face formed on a portion of the remaining zone of unfragmented formation after explosive expansion of such lift and determining the level of the fragmented mass below such new free face, for determining the amount of formation particles from the fragmented mass to be withdrawn to provide a void space of sufficient void volume below such new free face for substantially free expansion of formation in the next successive lift to be explosively expanded toward such void space; and (3) withdrawing such amount of formation particles from the fragmented mass through the lower level drift.

23. The method according to claim 22 in which such a lift is explosively expanded by detonating, in a single round, an array of vertical columnar charges of explosive spaced across the horizontal cross section of such lift.

24. The method according to claim 22 including withdrawing formation particles from the retort by drawing them downwardly through one or more draw points having a sufficiently large cross section for maintaining a substantially level top surface of the fragmented mass.

* * * * *